US006623808B1

(12) United States Patent
Jordan et al.

(10) Patent No.: US 6,623,808 B1
(45) Date of Patent: Sep. 23, 2003

(54) SPRAY DEPOSITION PROCESS

(75) Inventors: Richard Michael Jordan, Hook Norton (GB); Jonathan Betts, Swansea (GB); Patrick Grant, Oxford (GB); Allen Dennis Roche, Saline, MI (US); Piers Newbery, Chester, VA (US)

(73) Assignees: Ford Global Technologies, Inc., Dearborn, MI (US); Sprayform Holdings Limited, Swansea (GB)

( * ) Notice: Subject to any disclaimer, the term of this patent is extended or adjusted under 35 U.S.C. 154(b) by 0 days.

(21) Appl. No.: 09/890,446

(22) PCT Filed: Feb. 23, 2000

(86) PCT No.: PCT/US00/04494

§ 371 (c)(1),
(2), (4) Date: Feb. 1, 2002

(87) PCT Pub. No.: WO00/50177

PCT Pub. Date: Aug. 31, 2000

(30) Foreign Application Priority Data

Feb. 23, 1999 (GB) ..... 9903964

(51) Int. Cl.[7] ..... C23C 4/12

(52) U.S. Cl. ..... 427/455; 427/446; 427/456; 427/422; 164/46

(58) Field of Search ..... 427/446, 455, 427/456, 422; 164/46

(56) References Cited

U.S. PATENT DOCUMENTS

| | | | | |
|---|---|---|---|---|
| 4,542,539 A | | 9/1985 | Rowe, Jr. et al. | |
| 5,018,573 A | * | 5/1991 | Zohler et al. | 165/133 |
| 5,340,090 A | * | 8/1994 | Orme et al. | 266/202 |
| 5,817,267 A | | 10/1998 | Covino et al. | |

FOREIGN PATENT DOCUMENTS

| | | | |
|---|---|---|---|
| JP | 9165667 | | 6/1997 |
| JP | 09-243281 | * | 9/1997 |

OTHER PUBLICATIONS

Metals Handbook, Ninth Edition, vol. 5, Surface Cleaning, Finishing, and Coating, American Society For Metals, 1982, p. 361.*

* cited by examiner

*Primary Examiner*—Katherine A. Bareford
(74) *Attorney, Agent, or Firm*—Bliss McGlynn, P.C.

(57) ABSTRACT

A process for producing a metallic tool, mould, die or other body of significant thickness or a coating, the process comprising directing a spray (3, 4) comprising molten metallic droplets carried by a propelling gas toward an object surface (7) of a substrate or pattern (5) so as to build up a metallic deposit or coating comprising the mould, tool, die, body or coating on the object surface (7) of the substrate or pattern (5), wherein at one or more predetermined stages during spraying droplets of a relatively large mean size are sprayed and at one or more other stages droplets or a relatively smaller mean size are sprayed.

12 Claims, 1 Drawing Sheet

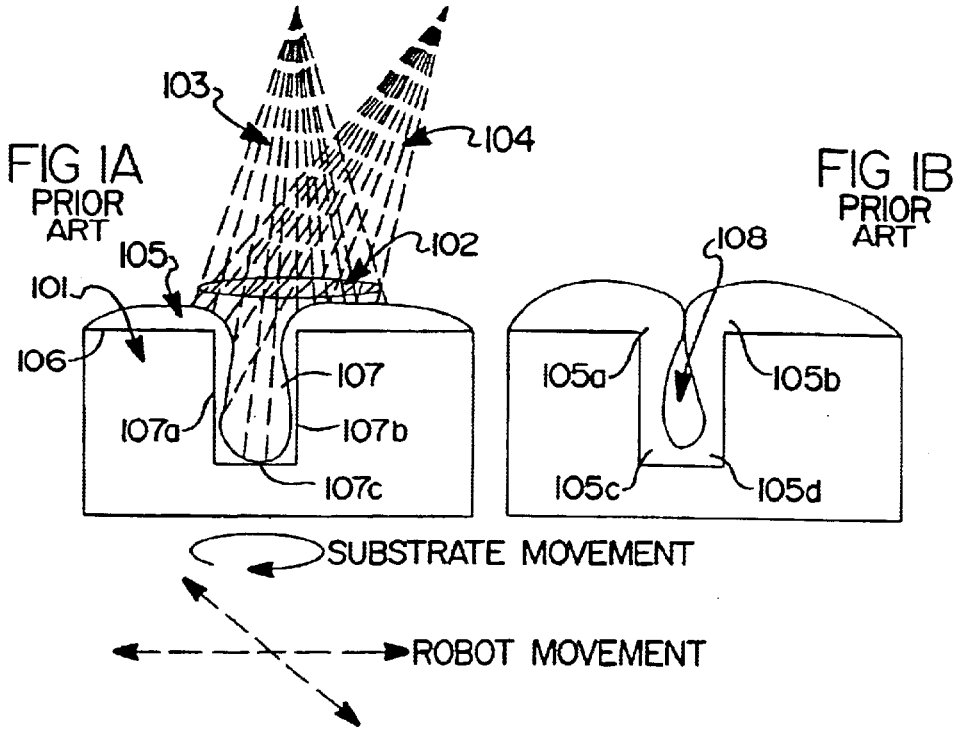
FIG 2
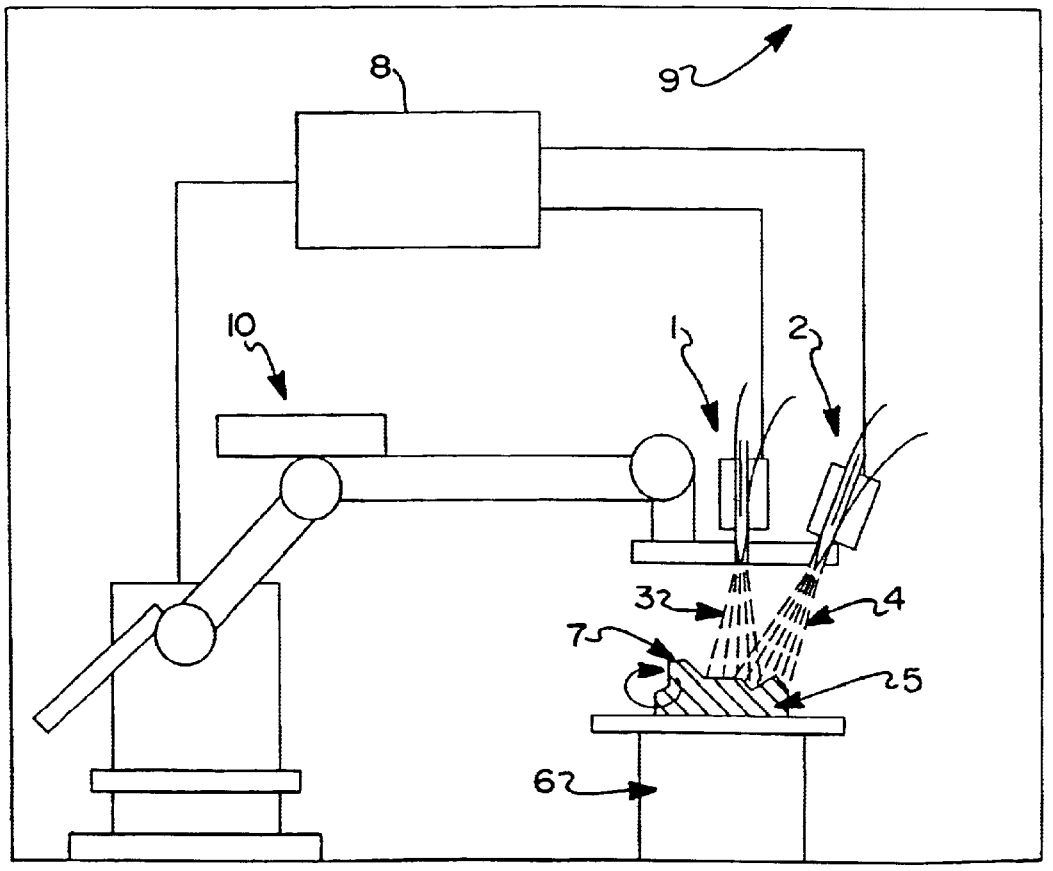

SPRAY DEPOSITION PROCESS

CROSS-REFERENCE TO RELATED APPLICATION(S)

The present application is a national stage application of PCT/US00/04494, filed Feb. 23, 2000.

BACKGROUND OF THE INVENTION

The present invention relates to a spray deposition process and in particular to a metallurgical spray deposition process.

The process is also useful for producing thick and thin coatings and other sprayed metal deposits sprayed onto substrates of all kinds, particularly where some of the topographical features are difficult to cover or fill due to complex geometries.

It is known to use metallurgical spray deposition techniques for producing tools, moulds, dies and other bodies of significant thickness. Problems have been encountered in using such techniques from the point of view of inherent porosity in the spray deposited material and internal stresses which arise during the spray deposition processes. Attempts have been made to deal with these problems and known techniques are described in, for example, WO-A-96/09421 and PCT patent application GB97/00590.

In a wide variety of commercially important thermal spray processes, the manner in which sprayed droplets impinge, spread and solidify on deposition is critical in influencing the subsequent properties of the manufactured coating or deposit. The first droplets to be deposited will determine the properties at the coating/substrate interface. In the case of spray forming of free standing shapes for mould tooling, the first deposited droplets determine the accuracy of replication and tooling wear properties. As deposition continues, droplet deposition behaviour controls the bulk microstructure (such as volume fraction, morphology and size of porosity) consequently determining the coating or deposit bulk properties. At all stages of deposition, droplet rebounding or splashing leads to a reduction in process yield. Recent experimental evidence suggests that droplet splashing occurs to a significant and greater extent than previously believed.

A further problem with sprayforming onto patterns or substrates having an object surface of varied (three dimensional) topography arises due to the fact that metal spray processes are "line of sight" processes in which Is known effects of shadowing and bridging occur for certain configurations of object surface topography.

A further problem occurs at internal and external edges of object surface topography, where poor quality deposit integrity can occur resulting in poor quality integrity to the deposit. This can result in flaking or crumbling of the deposit at corners and edges.

SUMMARY OF THE INVENTION

An improved spray deposition process has now been devised. According to the invention there is provided a process for producing a metallic tool, mould, die or other body of significant thickness or a coating, the process comprising directing a spray comprising molten metallic droplets carried by a propelling gas toward an object surface of a substrate or pattern so as to build up a metallic deposit or coating comprising the mould, tool, die, body or coating on the object surface of the substrate or pattern, wherein at one or more predetermined stages during spraying droplets of a relatively large mean size are sprayed and at one or more other stages droplets of a relatively smaller mean size are sprayed.

The relatively larger droplets are preferably sprayed at a stage preceding the spraying of relatively smaller droplets. Desirably, where the substrate or pattern includes topographical relief features, the spraying of the relatively larger droplets is dependent upon the nature of and/or the location of the topographical relief features.

It is a preferred feature of the invention that when spraying over portions of the object surface comprising topographical-features with a depth/width aspect ratio for example, or into or onto sharp corners or the like, that metallic droplets of relatively large sizes are sprayed, at least initially, in order to reduce shadowing, bridging, and poorly defined edge or corner detail which has been found to be a problem with prior art techniques.

It has been found that for producing detail and reducing shadowing or bridging, metallic spray droplets of mean diameters of substantially 200 microns and above (preferably substantially 350 microns and above) produce highly beneficial results. This result is surprising because trends in spray deposition research and practices have herebefore tended to suggest that finely sprayed droplets and relatively higher droplet spray velocities should produce improved results during the manufacture of coatings and most other products when using spray deposition techniques. Smaller droplet sizes have also been preferred because deposit porosity is minimised by using smaller droplet sizes. This is one of the premises behind the development of techniques such as plasma spraying and high velocity oxy-fuel metallic spraying techniques.

Additionally, spraying of larger droplet sizes for initial deposition, (including for coatings) has been found to result in reduced porosity in the deposited material immediately adjacent the substrate or pattern.

It is preferred that the propelling gas of the spray is within a pressure range lower than that normally recommended for use with a particular metal spraying apparatus. The operating pressure will therefore be different for different equipment, but is preferably at or about 3 bar or less. This results in the relatively large droplets desired, and relatively low droplet velocities compared with known techniques.

It is preferred that the droplets are produced by arc spraying, because arc spraying typically produces coarser droplet sizes than other known spray deposition processes. Conventional arc spraying apparatus has however not been designed for spraying at the larger droplet sizes of the present invention and modification and frequent cleaning of arc spray guns during proving of the invention has been found to be necessary. It is believed that this is strongly indicative of the process of spraying metallic droplets at the dimensions preferred being novel and inventive per se.

Preferably relatively high currents are used in the arc spraying process compared with the currents used in conventional arc spraying techniques.

It is important to control internal stresses in relatively thick deposited bodies formed in metallurgical spray deposition processes. WO-A-96/09421 discloses metallurgical spray deposition techniques which may be used to control internal stresses in deposited bodies. The relatively large droplet sizes required to improve reproduction of detail and edge definition from the object surface of the substrate or pattern (and also to inhibit bridging or shadowing) have however been found not to be suitable for control of stresses. It is therefore preferred that in the process according to the invention, process parameters are varied such that the relatively larger droplets are sprayed during the period and over the areas where detail of the substrate is required to be reproduced. Relatively smaller droplets are sprayed after the period when the detail has been replicated as required, and in other portions of the deposit where it is not required to replicate detail, preferably under conditions to control internal stresses in the deposit.

Typically therefore, the process according to the invention may comprise initial spraying of relatively large droplets onto the object surface of the substrate or pattern where detail replication is required (such as, for example, edge definition is to be reproduced, and/or where shadowing is to be avoided), and then subsequent modification of the spray parameters, (preferably as soon as possible after the said pattern detail and edge definition have been achieved), so as to spray relatively smaller droplets onto the object surface of the pattern or substrate. (Preferably in order to bring stress control into operation, as described, for example, in WO-A96/09421).

Alternatively, the process may comprise spraying of relatively large droplets from one spray source onto the object surface of the substrate or pattern where detail is required (such as edge definition is to be reproduced, and/or shadowing effects are to be ameliorated), and introducing a further spray of relatively smaller metallic droplets from a second spray source (preferably concurrently with the first spray), the further spray preferably being tailored to minimise internal stresses in the deposit.

It is preferred that the control step c) is operated by control means (preferably computer control means) and pre-programmed.

To achieve the required control, one or more spray guns are preferably mounted on manipulator means, such as an industrial robot which is preferably programmed, advantageously together with the spray guns, by the control means. Alternatively, or additionally, the one or more sprays of metallic droplets generated by the spray guns may be scannable, in which case the means for scanning the sprays is preferably coordinated and controlled, preferably by the same control means.

BRIEF DESCRIPTION OF THE DRAWINGS

The invention will now be further described, by way of example only, and with reference to the accompanying drawings in which:

FIGS. 1(*a*) and 1(*b*) are explanatory sectional views of known spray deposition processes, highlighting the problem of shadowing and bridging known in the prior art.

FIG. 2 is a schematic view of apparatus for use in the process according to the invention.

DESCRIPTION OF THE PREFERRED EMBODIMENT(S)

Referring to FIG. 1(*a*), there is shown a substrate 101 rotated beneath a pair of arc-sprayed metallic droplet sprays 103 and 104. The arc sprayed metallic droplets are sprayed from two arc spray guns mounted on a 6-axis industrial robot (not shown) to produce a sprayed footprint 102, which is moved over the substrate by the robot manipulating the guns together, to produce a deposit 105 re-producing the object surface 106 of the substrate 101. The surface topography of object surface 106 is such that it is provided with a channel 107 having a pair of parallel sides 107*a*, 107*b* and a perpendicular surface 107*c*. As the spray deposition continued, the sprayed deposit 105 builds up on the object surface 106 eventually bridges the width of channel 107 leaving a void 108, as shown in FIG. 1(*b*) caused by the shadowing effect of the build up of deposit 105.

It has been found, surprisingly, that by initial spraying with droplets of larger size than used conventionally in spray deposition metallurgical techniques, the effects of shadowing and bridging, in situations where the surface topography of the object surface 106 is varied, are modified substantially. Furthermore, external and internal deposited edges (such as edges 105*a* to 105*d*) are formed with superior integrity than would otherwise be the case where droplets of conventional size are used. It has been found that sprays having droplets distributed about gaussian mean of 200 microns and above (preferably 350 microns and above) provide significant process advantages. It is believed that the use of larger droplets may provide enhanced process performance because one or either of the following occur:

(a) droplets have increased momentum and remain liquid longer with more opportunity for flow driven by the momentum;

(b) "splashing" of particles on impingement with substrate or deposit lessens "line of sight" problems.

Using the apparatus shown in FIG. 2 the improved performance of the process according to the invention can be achieved. The apparatus of FIG. 2 comprises arc spray guns 1,2 mounted on a 6-axis industrial robot 10, producing atomised metal sprays 3,4 which impinge upon Is pattern or substrate 5. Pattern or substrate 5 sits on a rotating table 6, and is provided with a varied topography object surface 7. A computer control arrangement 8 is used to control manipulation of the robot 10, and also coordinate and control process parameters of the respective sprays 3,4 produced by guns 1,2 (such as, for example, the gas spraying pressure, and wire feed rate/current of the respective guns 1,2). The apparatus is completely enclosed within a dust-proof acoustic chamber 9, connected to an appropriate dust-and fume extraction system (not shown).

EXAMPLE

Both spray guns 1,2 were used to spray low carbon steel (from stock feed wire). For the particular model of arc spray guns used, an initial spray droplet size of approx. 350 microns could be achieved by means of propelling compressed gas at a pressure of 2.6 bar. These conditions were maintained for a period of approximately 120 seconds, for both spray guns. This length of time was sufficient to ensure that all internal and external edges of the object surface of the substrate were covered by deposited spray having droplets of average diameter 350 microns approx. Spraying parameters for both arc spray guns were then adjusted by increasing the pressure of the propelling gas to 3.5 bar and simultaneously decreasing the current supply in order to decrease the rate of generation of molten metal in the arc. These conditions were used to produce a finer droplet size below 150 microns for building up the remainder of the deposit, and to control stresses according to WO-A-96/09421.

The deposit was subsequently released from the substrate 5 and found to have improved edge integrity and less extensive shadowing or bridging defects than would have been the case when conventionally spraying with droplet sizes of less than 150 microns throughout the process.

What is claimed is:

1. A process for producing a metallic tool, mould, die or other body of significant thickness or a coating, the process comprising the steps of directing a spray comprising molten metallic droplets toward an object surface of a substrate or pattern so as to build up a metallic deposit or coating comprising the mould, tool, die, body or coating on the object surface of the substrate or pattern, wherein at one or more predetermined stages during spraying droplets of a relatively large mean size are sprayed and at one or more other stages droplets of a relatively smaller mean size are sprayed and wherein the relatively large droplets are initially sprayed onto the object surface of the substrate or pattern and have a mean diameter of substantially two hundred microns and greater.

2. A process according to claim 1, wherein the droplets are produced by arc spraying.

3. A process according to claim 1, wherein at one stage in the deposition process substantially only droplets of relatively larger mean size are sprayed.

4. A process according to claim 1, further comprising spraying of relatively large droplets-from one spray source onto the object surface of the substrate or pattern and introducing a further spray of relatively smaller metallic droplets from a second spray source.

5. A process according to claim 4, wherein the further spray of relatively smaller metallic droplets is operated concurrently with the first spray.

6. A process according to claim 1, wherein a change between spraying of relatively larger and smaller droplet size sprays is operated by pre-programmed control means.

7. A process for producing a metallic tool, mould, die or other body of significant thickness or a coating, said process comprising the steps of:

directing a spray comprising molten metallic droplets carried by a propelling gas toward an object surface of a substrate or pattern so as to build up a metallic deposit or coating comprising the mould, tool, die, body or coating on the object surface of the substrate or pattern, wherein at one or more predetermined stages during spraying droplets of a relatively large mean size are sprayed, and at one or more other stages droplets of a relatively smaller mean size are sprayed; and wherein the relatively larger droplets have a mean diameter of substantially two hundred microns and greater and are sprayed at a stage preceding the spraying of relatively smaller droplets.

8. A process for producing a metallic tool, mould, die or other body of significant thickness or a coating, said process comprising the steps of:

directing a spray comprising molten metallic droplets carried by a propelling gas toward an object surface of a substrate or pattern so as to build up a metallic deposit or coating comprising the mould, tool, die, body or coating on the object surface of the substrate or pattern, wherein at one or more predetermined stages during spraying droplets of a relatively large mean size are sprayed and at one or more other stages droplets of a relatively smaller mean size are sprayed; and wherein a metallic tool, mould, die or other body of significant thickness is produced on a substrate or pattern including topographical relief features, the switching between spraying relatively larger and smaller droplets being dependent upon the nature of and/or the location of the topographical relief features.

9. A process according to claim 8, wherein the relatively larger droplets are sprayed onto the topographical relief surface, the spray subsequently being switched to spray the relatively smaller droplets.

10. A process for producing a metallic tool, mould, die or other body of significant thickness or a coating, said process comprising the steps of:

directing a spray comprising molten metallic droplets carried by a propelling gas toward an object surface of a substrate or pattern so as to build up a metallic deposit or coating comprising the mould, tool, die, body or coating on the object surface of the substrate or pattern, wherein at one or more predetermined stages during spraying droplets of a relatively large mean size are sprayed and at one or more other stages droplets of a relatively smaller mean size are sprayed; and wherein when spraying droplets of the relatively smaller size, spray parameters are tailored to control internal stresses in the deposited metal.

11. A process according to claim 10, wherein the spray parameters are tailored to effect phase change or reaction in the deposited metal.

12. A process according to claim 10, wherein the spray parameters are tailored to effect martensitic phase change in the deposited metal.

* * * * *